United States Patent [19]

Hanula

[11] 4,328,900

[45] May 11, 1982

[54] ROTARY COUPLER WITH IMPROVED PIN BEARING

[75] Inventor: Richard M. Hanula, Lyndhurst, Ohio

[73] Assignee: Midland-Ross Corporation, Cleveland, Ohio

[21] Appl. No.: 186,475

[22] Filed: Sep. 12, 1980

[51] Int. Cl.[3] ..... B61G 9/00

[52] U.S. Cl. ..... 213/62 A

[58] Field of Search ..... 213/62 R, 62 A, 63, 213/64, 65, 67 R, 67 A, 69–72

[56] References Cited

U.S. PATENT DOCUMENTS 2,235,618 3/1941 Larsson ..... 213/62 A 3,104,017 9/1963 Kulieke et al. ..... 213/62 A 3,157,291 11/1964 Kulieke et al. ..... 213/62 A

*Primary Examiner*—Richard A. Bertsch

*Attorney, Agent, or Firm*—Harlan E. Hummer

[57] ABSTRACT

A rotary F coupler is disclosed as having a rotary connector and pivot pin arrangement which provides increased bearing contact between these two components. This is accomplished by the provision in the rotary connector of a dual diameter pinhole opening which is designed to receive a matingly configured dual diameter pivot pin which is distinct from prior art pivot pins that have a uniform diameter between its opposing ends.

8 Claims, 4 Drawing Figures

ROTARY COUPLER WITH IMPROVED PIN BEARING

BACKGROUND OF THE INVENTION

The invention is particularly well suited for use in a rotary F coupler as described, for example, in U.S. Pat. No. 2,990,963 which describes a rotary connector which has a ledge for supporting the pin used to fasten the coupler to the connector that is rotatable within the yoke of the draft gear which is secured to the underside of a railroad car body. The provision of such ledges reduces the bearing area between the pin and rotary connector, especially if the ledge is made sufficiently thick to withstand the stresses imposed upon it by the pin. It has been found that a good thick ledge critically reduces the bearing area of the rotary connector and a ledge of insufficient thickness causes the rotary connector to fracture and break in this area. The invention is directed to improving the bearing between the pin and rotary connector without critically reducing the thickness of the ledge used in supporting the pin within the connector.

Briefly stated, the invention is in a rotary railroad car coupler that comprises a coupler head and a shank which extends from the head and terminates at a butt end in which is located a pinhole that extends transversely through the shank. The butt end of the coupler shank is pinned within a rotary connector that is provided with a pair of opposing sides which have aligned openings that are, in turn, aligned with the pinhole in the coupler shank when the butt end of the shank is properly inserted within the rotary connector. The opening in one of the opposing sides of the rotary connector is restricted by at least two opposing abutments. The pin that is used to couple the butt end of the coupler shank to the rotary connector, is formed from at least two cylindrical pin portions of different diameters that fit within and span the pair of aligned openings in the rotary connector. An annular stop is formed between the two pin portions and is designed to rest against the two opposing abutments of the rotary connector, when the pin is properly inserted so that the pin is generally coextensive with the pinhole of the shank and the aligned openings in the rotary connector.

The use of a pivot pin with different diameters permits the optimization of the pin length without sacrificing the thickness of the ledges used to support the pin within the rotary connector.

DESCRIPTION OF THE DRAWING

The following description of the invention will be better understood by having reference to the accompanying drawing wherein.

ENVIRONMENT OF THE INVENTION

Figure 1:
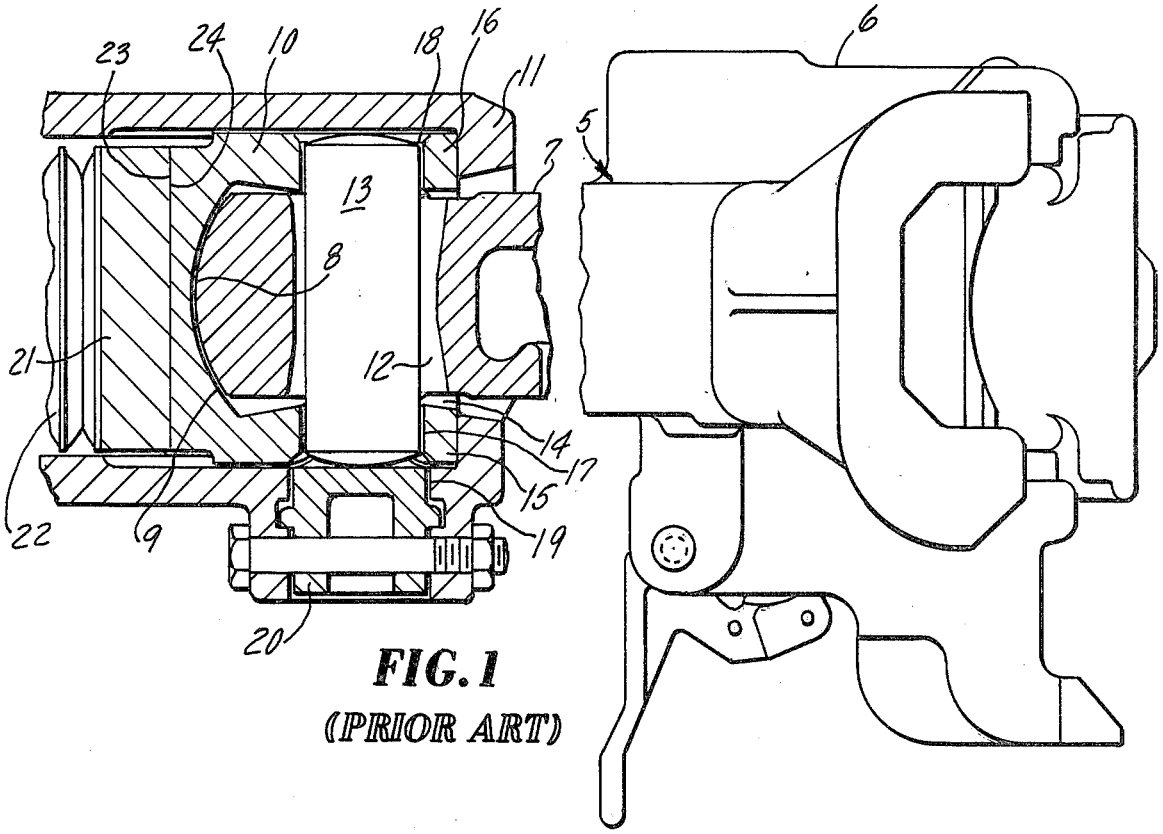
FIG. 1 (PRIOR ART)
FIG. 1 is a side view of a conventional prior art coupler and draft gear arrangement with the butt end of the coupler shank and adjacent draft gear arrangement being shown in cross section.

With general reference to the drawing for like parts and particular reference to FIG. 1, there is shown a rotary F coupler 5 which comprises a coupler head 6, a shank 7 extending from the coupler head 6 and terminating at a spherical butt end 8 which is designed to engage a correspondingly shaped concave seat 9 of a rotary connector 10 which is mounted by any suitable means for rotation within a yoke 11. A pinhole 12 extends transversely through the coupler shank 7 adjacent the butt end 8 of the coupler 5 and is designed to receive a pivot pin 13 which is used to couple the butt end 8 of the coupler shank 7 to the rotary connector 10, when the butt end 8 is properly inserted within a pocket 14 that is formed within the rotary connector 10.

The rotary connector 10 has a pair of opposing sides 15,16 with aligned first and last openings 17,18, relative to entry of the pivot pin 13, which in turn are in alignment with the pinhole 12 when the butt end 8 of the coupler shank 7 is properly seated or positioned within the pocket 14 of the rotary connector 10. The yoke 11 is provided with a bottom opening 19 through which the pivot pin 13 is inserted into the aligned openings 17,18 of the rotary connector 10 and the pinhole 12 of the coupler shank 7 so that the pivot pin 13 is in a vertical position when the coupler 5 is in the normal horizontal operating position for interlocking engagement with a similar coupler of an adjacent railroad car. A conventional block 20 is secured within the opening 19 of the yoke 11 to retain the pivot pin 13 in place. Unfortunately, the pivot pin 13 rides on the retainer block 20 when the coupler 5 is in a normal operating position. It can be imagined that, upon wear of the retainer block 20, a pair of spaced offsets will be created between the block 20 and adjacent portions of the yoke 11. Contact of the pivot pin 13 with such offsets can disrupt rotation of the coupler 5.

The rotary connector 10 is prevented from moving rearwardly in the yoke 11 in a direction away from the coupler head 6 by means of a front follower 21 against which a spring load is applied by any suitable means, e.g. a stack of rubber cushion pads 22. The front follower 21 has a flat face 23 for abutting contact with an adjacent flat face 24 of the rotary connector 10.

Figure 2:
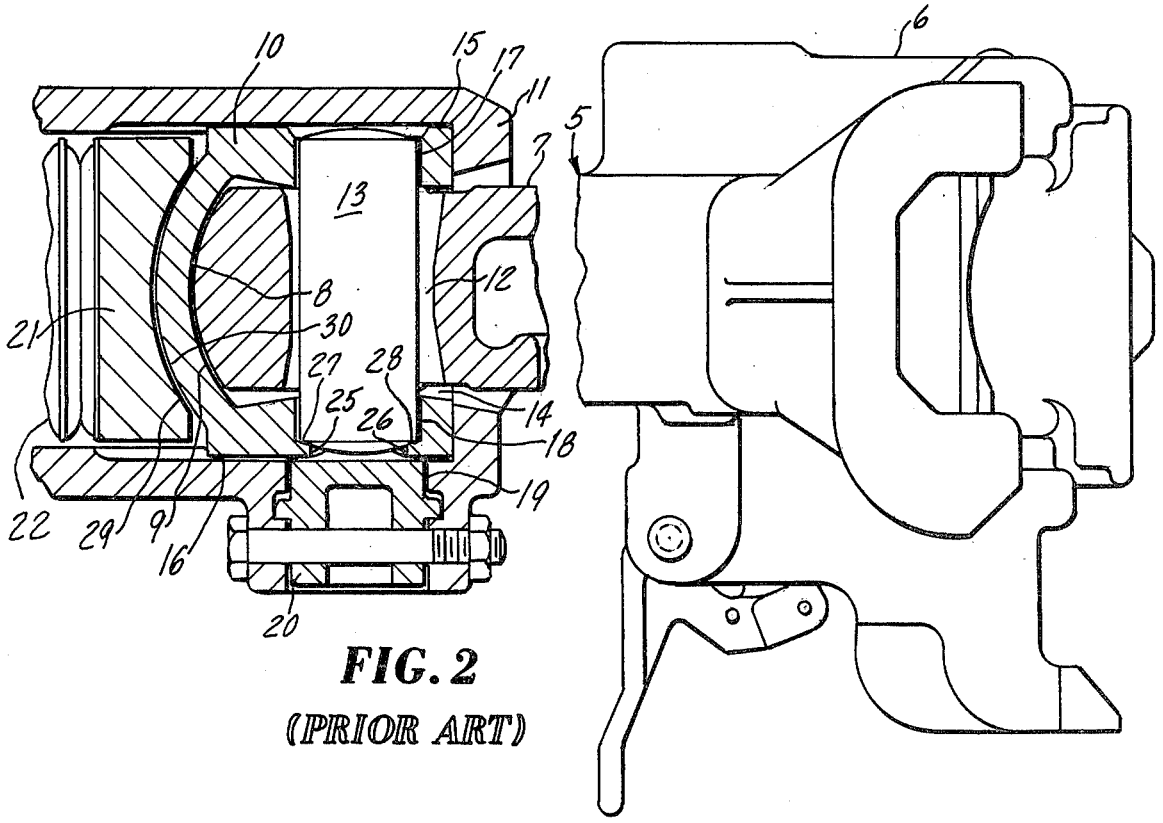
FIG. 2 (PRIOR ART)
FIG. 2 is a similar view of another prior art coupler as exemplified in the aforementioned U.S. Pat. No. 2,990,963.

The embodiment of FIG. 2 differs from that of FIG. 1 in that the coupler is rotated 180° to a normal operating position after the pivoted pin 13 is inserted into the bottom opening 19 of the yoke 11. Furthermore, the rotary connector 10 is provided with a pair of lugs 25,26 which project into and restrict the last opening 18 and form a pair of opposing ledges or abutments 27,28 which are designed to support the pin 13 in spaced relation from the retainer block 20 to keep the pin 13 from contacting and wearing the block 20 when the coupler 5 is in a normal operating position. This improved design prevents the formation of the offsets previously referred to, but reduces the pin bearing surfaces of the rotary connector 10. In this instance, the front follower 21 is provided with a concavity 29 for seating engagement with the spherical butt end 30 of the rotary connector 10.

The Invention

Figure 3:
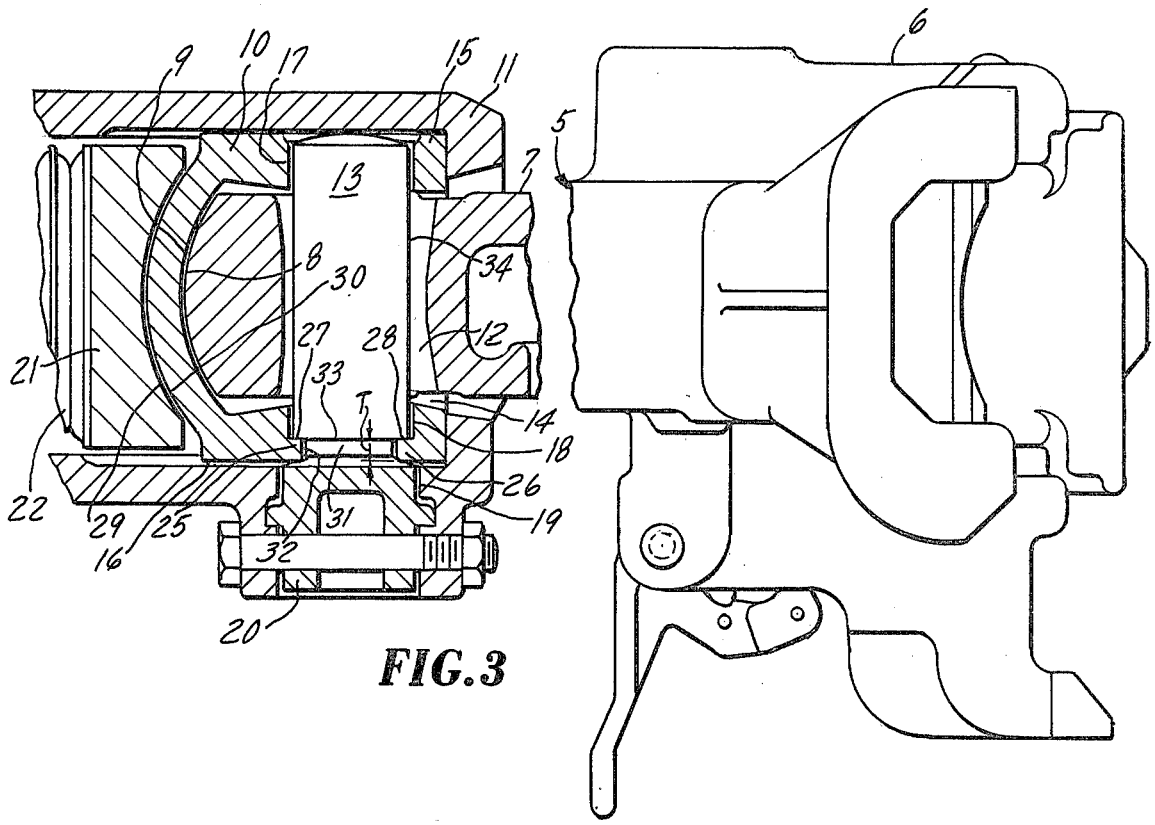
FIG. 3 is a similar view of a coupler that is made in accordance with the invention.

The rotary coupler 5 of FIG. 3 differs from that of FIG. 2 in that the pivot pin 13 is provided with a coaxial, smaller diameter, cylindrical pin portion 31 which extends into the restricted opening 32 between the opposing lugs 25,26. An annular stop or shoulder 33 is formed between the smaller diameter pin portion 31 and the normally sized, larger diameter pin portion 34 of the pivot pin 13, and is designed to contact or rest against the ledges or abutments 27,28 in the last opening 18 of the rotary connector 10. The overall length of the smaller diameter pin portion 31 is slightly shorter than the correspondingly measured thickness T of the lugs 25,26, so that the pivot pin 13 is free of contact with the retainer block 20 when the coupler 5 is in a normal, unrotated operating position. The smaller diameter pin portion 31 coacts with the lugs 25,26 to provide increased bearing between the pivot pin 13 and the rotary connector 10. It can be appreciated that the thickness T of the lugs 25,26 can be increased and strengthened without seriously affecting or sacrificing the bearing between the pivot pin 13 and the rotary connector 10. In some cases, the two opposing lugs 25,26 of the rotary connector 10 can be in the form of a single annular lug to form an annular abutment in the last opening 18.

Figure 4:
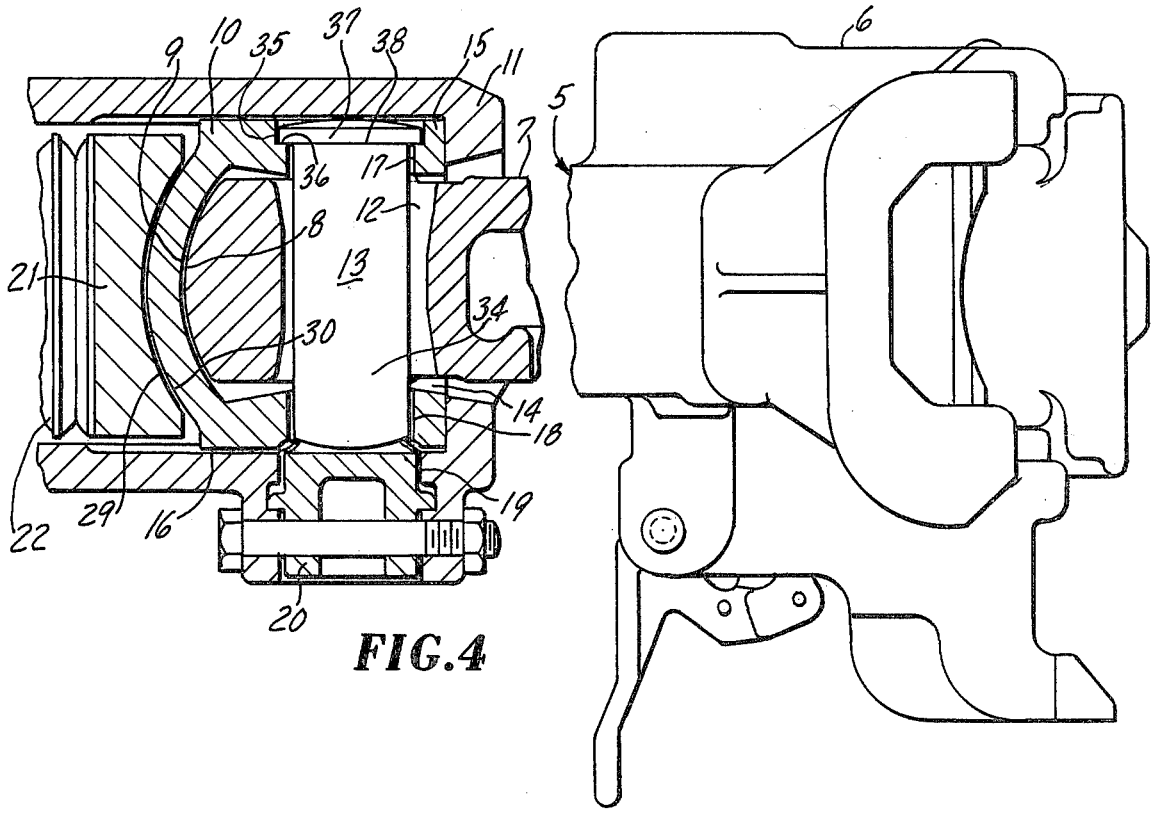
FIG. 4 is a similar view of another coupler which is made in accordance with the invention.

The embodiment of the invention shown in FIG. 4 differs from that of FIG. 3 in that there are no lugs to restrict the last opening 18 in the rotary connector 10. Instead, a larger diameter opening 35 is provided in coaxial alignment atop the first opening 17 in the opposing side 15 of the rotary connector 10. These two different diameter openings 17,35 produce, in essence, a pair of abutments in the form of an annular abutment 36 for restricting the larger diameter opening 35. The normal size pivot pin 13 is provided with a larger diameter cylindrical cap or head 37 which fits in the larger diameter opening 35. The two different diameter pin portions, e.g. the head 37 and smaller pin portion 34, form between them an annular stop 38 for engaging the annular abutment 36 to maintain the pivot pin 13 in spaced relation from the retainer block 20, when the coupler is in a normal operating position. This structural arrangement also provides increased bearing between the rotary connector 10 and pivot pin 13. It must be mentioned that this particular embodiment necessitates the use of costlier, larger diameter pin stock, if the pins are used with conventional rotary connectors.

Thus, there has been described a highly improved rotary connector and pivot pin arrangement, wherein increased bearing is achieved while maintaining the pivot pin free of the retainer block when the coupler is in a normal unrotated operating position.

What is claimed is:

1. A rotary railroad car coupler, comprising:

(a) a coupler head having a shank extending therefrom and terminating at a butt end, the shank having a pinhole extending transversely therethrough adjacent the butt end;

(b) a rotary connector rotatable about an axis and having a pair of opposing sides which at least help form a pocket for receiving the butt end of the coupler shank, the sides having aligned openings which are alignable with the pinhole in the coupler shank when the butt end of the shank is properly inserted in the pocket;

(c) at least a pair of opposing support abutments restricting the opening in at least one of the opposing sides of the connector; and (d) a pivot pin insertable in the openings of the rotary connector and the pinhole for mounting the coupler shank to the rotary connector, the pivot pin being formed by at least two concentric cylindrical pin portions which are of different diameters and which extend into the openings and which form between them an annular stop which contacts the abutments in the rotary connector, the different diameter pin portions designed to bear against adjacent sides of the openings.

2. The rotary railroad car coupler of claim 1, wherein the major portion of the pivot pin measured lengthwise, has a larger diameter than the remaining portion thereof.

3. The rotary railroad car coupler of claim 2, wherein the support abutments are formed in the last opening in the rotary connector to be entered by the pivot pin during mounting of the shank to the rotary connector.

4. The rotary railroad car coupler of claim 3, wherein the support abutments are formed by at least two opposing lugs which extend into the opening, the lugs having a thickness (T), measured longitudinally of the opening, which is at least equal to the length of the smaller diameter pin portion measured longitudinally of the pivot pin.

5. The rotary railroad car coupler of claim 3, wherein the support abutments include a single annular abutment.

6. The rotary railroad car coupler of claim 1, wherein the major portion of the pivot pin, measured lengthwise, has a smaller diameter than the remaining portion thereof.

7. The rotary railroad car coupler of claim 6, wherein the support abutments are formed in the first opening in the rotary connector to be entered by the pivot pin during mounting of the shank to the rotary connector.

8. The rotary railroad car coupler of claim 7, wherein the support abutments are an annular abutment formed between the first opening and a coaxial larger diameter opening for receiving the larger diameter portion of the pivot pin, the annular stop contacting the annular abutment.

* * * * *